US006627311B2

(12) United States Patent
Horikami et al.

(10) Patent No.: US 6,627,311 B2
(45) Date of Patent: Sep. 30, 2003

(54) POLYESTER TAPE YARN

(75) Inventors: Hideki Horikami, Toyama-ken (JP); Mikio Maruyama, Toyama-ken (JP)

(73) Assignee: Diatexs Co., Ltd., Tokyo (JP)

( * ) Notice: Subject to any disclaimer, the term of this patent is extended or adjusted under 35 U.S.C. 154(b) by 0 days.

(21) Appl. No.: 10/198,471

(22) Filed: Jul. 18, 2002

(65) Prior Publication Data

US 2003/0021992 A1 Jan. 30, 2003

(30) Foreign Application Priority Data

Jul. 27, 2001 (JP) ..... 2001-228271

(51) Int. Cl.[7] ..... D01F 6/00

(52) U.S. Cl. ..... 428/364; 428/395; 428/397; 57/248; 57/243

(58) Field of Search ..... 428/364, 395, 428/397; 57/248, 243

(56) References Cited

U.S. PATENT DOCUMENTS 4,036,003 A * 7/1977 Lowder et al. ..... 57/140 R 4,179,875 A * 12/1979 Gibbon ..... 57/248

* cited by examiner

*Primary Examiner*—N. Edwards

(74) *Attorney, Agent, or Firm*—Norris McLaughlin & Marcus

(57) ABSTRACT

The present invention is polyester tape yarn excellent in mechanical strength and dye affinity, and, therefore, suitable as fancy work yarn formed through uniaxial orientation of polyester having the ultimate viscosity of 0.7 or more, and has the tensile strength of 1.0 cN/dt or more, the Knot strength represented by the below-mentioned formula (1) of 0.8 cN/dt, the Loop strength represented by the below-mentioned formula (2) of 1.8 cN/dt or more, and the yarn width of 0.5 mm or more.

Knot strength:

Knot strength($cN/dt$)=node strength($N$)×100/fineness ($dt$) Formula (1)

Loop strength:

Loop strength($cN/dt$)=scratch strength($N$)×100/fineness ($dt$) Formula (2)

5 Claims, 2 Drawing Sheets

POLYESTER TAPE YARN

BACKGROUND OF THE PRESENT INVENTION

1. Field of the Invention

The present invention relates to polyester tape yarn made of polyester and, more particularly, to polyester tape yarn made of polyester that is excellent in mechanical strength and dye affinity, and, therefore, suitable as fancy work yarn.

2. Description of the Related Art

Fancy work has been here to stay in years, and a variety of pieces of work are being created, leading to a demand for a wide range of kinds of fancy work yarn.

On the other hand, the demand for synthetic resins such as polypropylene, polyamide and polyester is on the rise as raw materials of fiber owing to their high intensity and excellent mass-production efficiency.

However, it is rather difficult to stock fibers produced with various kinds of hues, using pre-dyed materials, because materials for fancy work are often manufactured on the basis of small-lot production of a wide variety of products.

So, a rear dyeing system, in which colorless or white fibers are produced in the first place and they are dyed and shipped in response to the fashion and/or demand later, are presently applied.

The tape yarn conventionally used in the rear dyeing system has been made of rayon, which excels in dye affinity.

However, the rayon tape yarn varies in strength or tensile, resulting in the difficulty of securing certain qualities of products. And a high cost is another problem that the rayon yarn has.

Therefore, development of such tape yarn as is less expensive and more excellent in dye affinity as well as in mechanical and physical strengths has been in demand.

SUMMARY OF THE INVENTION

The first object of the present invention is to provide the polyester tape yarn that is suitable as fancy work yarn.

The second object of the present invention is to provide the polyester tape yarn that is suitable as fancy work yarn excellent in touch and mechanical strength.

The other object of the present invention is to provide the polyester tape yarn that is excellent in dye affinity, and is suitable in the rear dyeing system as being dyed into any color in response to demand and provide.

And the other object of the present invention is to provide the polyester tape yarn that is suitable to provide on the basis of small-lot production of a wide variety of products by means of that it is stocked in the form of white or colorless tape yarn and dyed into any color in response to demand.

The above object of the present invention are achieved by the following inventions;

Polyester tape yarn that is formed through uni-axial orientation of polyester having the ultimate viscosity of 0.7 or more, and is 1.0 cN/dt or more intensile strength, 0.8 cN/dt or more in Knot strength represented by the below-mentioned formula (1), 1.8 cN/dt or more in Loop strength represented by the below-mentioned formula (2), and 0.5 mm or more in yarn width.

$$\text{Knot strength}(cN/dt) = \text{node strength}(N) \times 100/\text{fineness}(dt) \qquad \text{Formula (1)}$$

$$\text{Loop strength}(cN/dt) = \text{scratch strength}(N) \times 100/\text{fineness}(dt) \qquad \text{Formula (2)}$$

Furthermore, the present invention is to provide the aforementioned polyester tape yarn having a lot of slits formed in the longitudinal direction, the aforementioned polyester tape yarn made of polyester containing inorganic filler at least on the surface, the aforementioned polyester tape yarn having the polyester layer containing inorganic filler on the one or both sides of the tape yarn, and the aforementioned polyester tape yarn having the thermoplastic resins layers varying in melting point or ultimate viscosity that forms a mound through heat treatment.

DESCRIPTION OF THE INVENTION AND PREFERRED EMBODIMENTS

Figure 1:
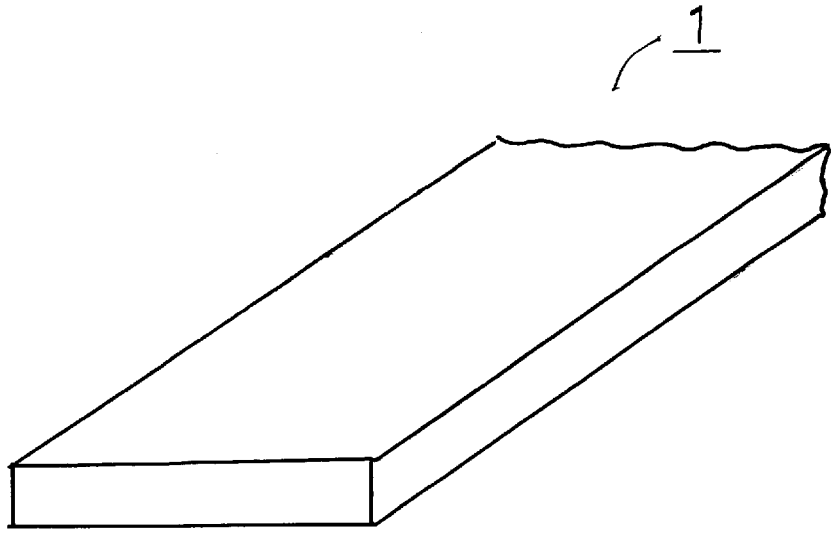
FIG. 1 is a perspective view showing an embodiment of the polyester tape yarn according to the present invention.
Figure 2:
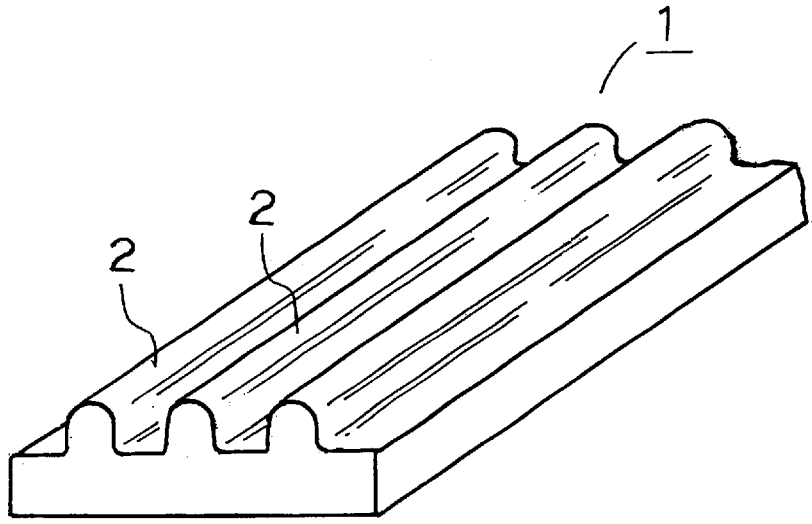
FIG. 2 is a perspective view showing an another embodiment of the polyester tape yarn according to the present invention.

The polyester tape yarn according to the present invention comprises polyester resins having a specific character with the ultimate viscosity of 0.70 or more and, more preferably, 0.85 or more. Polyester resins having the viscosity lower than 0.70 are not preferable, since their processability is inferior and their intensity declines.

In the present invention, homopolymer and/or copolymer of polyethylene terephthalate are illustrated as the polyester resins.

The homopolymer of polyethylene terephthalate is mainly made by reaction between terephthalic acid ingredient and ethylene glycol ingredient.

The polyethylene terephthalate copolymer obtained through copolymerization by one or more kinds of bifunctional carboxylic acid within 15 mol. % and, more preferably, 5 mol. % for part of terephthalic acid ingredient.

One or more kinds of bifunctional carboxylic acid such as aromatic dicarboxylic acids including isophthalic acid, naphthalene dicarboxylic acid, diphenyl dicarboxylic acid, diphenoxyethane dicarboxylic acid, phenylether dicarboxylic acid and diphenyl sulfone dicarboxylic acid, or alicyclic dicarboxylic acid including hexahydroterephthalic acid and hexahydroisophthalic acid, or aliphatic dicarboxylic acid including adipic acid, sebacic acid, azelaic acid, or oxyacid including p-β-hydroxyethoxybenzoic acid. The bifunctional carboxylic acid, for example, are illustrated as the above bifunctional carboxylic acid.

And the polyethylene terephthalate copolymer obtained through copolymerization by one or more kinds of polyfunctional compounds within 15 mol. % and, more preferably, 5 mol. % for part of ethylene glycol ingredient.

One or more kinds of polyfunctional compounds such as glycols including trimethylene glycol, tetramethylene glycol, hexamethylene glycol, decamethylene glycol, neopentyl glycol, diethylene glycol, 1,1-cyclohexanedimethylol, 1,4-cyclohexanedimethylol, 2,2-bis(4'-β-hydroxyethoxyphenyl)propane, bis(4'-β-hydroxyethoxyphenyl)sulfonic acid, and their functional derivatives, for example, are illustrated as the above polyfunctional compounds.

In the present invention, what can be used are such polyester resins as are 1.0 cN/dt or more and, more preferably, 1.5 cN/dt or more in tensile strength, 0.8 cN/dt or more and, more preferably, 1.0 cN/dt or more in Knot strength, 1.8 cN/dt or more and, more preferably, 2.0 cN/dt or more in Loop strength.

The Knot strength is the node strength defined in JIS L-1013. The Knot strength is calculated through division by the fineness of the tension at the moment of rupture of a measuring sample that has been tied into a knot, and attached to a tensile test machine, then pulled at a certain constant speed, using the following formula(1):

$$\text{Knot strength}(cN/dt)=\text{node strength}(N)\times 100/\text{fineness}(dt) \qquad \text{Formula (1)}$$

The Loop strength is the scratch strength defined in JIS-L1013. The Loop strength is calculated through division by the fineness of the tension at the moment of rupture of a measuring sample that has been made chained, and attached to atensile test machine, thenpulledat a certain constant speed, using the following formula(2):

$$\text{Loop strength}(cN/dt)=\text{scratch strength}(N)\times 100/\text{fineness}(dt) \qquad \text{Formula (2)}$$

Such polyester resins can be experientially obtained through selection of polymerization components of polyester resins, selection of ultimate viscosities or selection of forming conditions.

These polyester resins can be mixed, if necessary, with different kinds of resins or various kinds of additives such as olefin series polymer including high density polyethylene, low density polyethylene, linear low density polyethylene, propylene polymer, ethylene-propylene copolymer and ethylene-vinyl acetate copolymer; thermoplastic resins such as polyamide; lubricants within amide series, wax series, organic metal salt series and ester series; flame retardant such as bromine-laced organic series and phosphoric acid series; organic pigment; inorganic pigment; organic filler; inorganic or organic antimicrobials such as metal ion series.

Also, these polyester resins can be mixed with antistatic agent. The antistatic agent usable under the present invention is surfactant, which can be anionic, cationic, nonionic or ampholytic.

The anionic surfactant can be used higher alcohol ester sulfate or alkylallyl sulfonate.

The cationic surfactant can be used products that are obtained through transformation into hydrochloride or hydrobromide of broader ammonia derivatives such as amide group, imido group, tertiary amine, pyridinium, quinolinium, imidazolium compound.

The nonionic surfactant can be used ester compounds of higher alcohol and polyhydric alcohol such as polyethylene glycol, pentaerythritol and glucose, or etherified compounds of higher alcohol.

These ingredients are combined in any proportion, if necessary, and mixed or hot-kneaded in an ordinary mixer or a kneader such as Henschel mixer, Supermixer, V-blender, tumbler mixer, ribbon mixer, Bambery mixer, kneader-blender and single- or twin-screw extruder, and thereafter formed into film. Either extrusion molding by means of T-die or inflation molding is applicable as a forming method.

Figure 3:
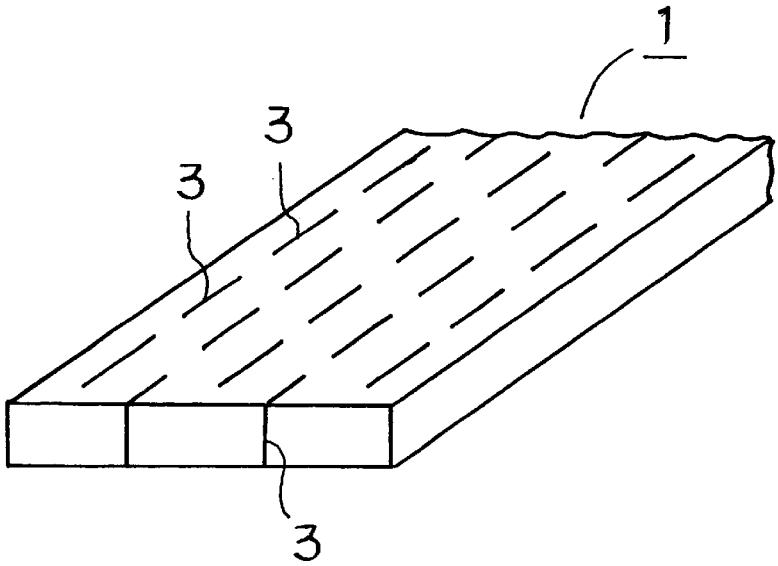
FIG. 3 is a perspective view showing an another embodiment of the polyester tape yarn according to the present invention.

The polyester tape yarn according to the present invention is composed of uniaxial oriented tape 1, which can be flat tape-state as shown in FIG. 1, but can be provided with small ribs 2 in the longitudinal direction that improve the yarn's feeling. And, the polyester tape according to the present invention can also be endowed with softness by becoming what is called split yarn that has splits 3 in the longitudinal direction as shown in FIG. 3.

Furthermore, inorganic filler can be added, which addition develops micro-cracks when the polyester is stretched, improving dye affinity and improving feeling owing to delustering. The inorganic fillers usable is talc, carbon black, graphite, titanium dioxide, silica, mica, calcium carbonate, calcium sulfate, barium carbonate, magnesium carbonate, magnesium sulfate, barium sulfate, alumina, kaolin, silicon carbide, metal powder or the like.

Figure 4:
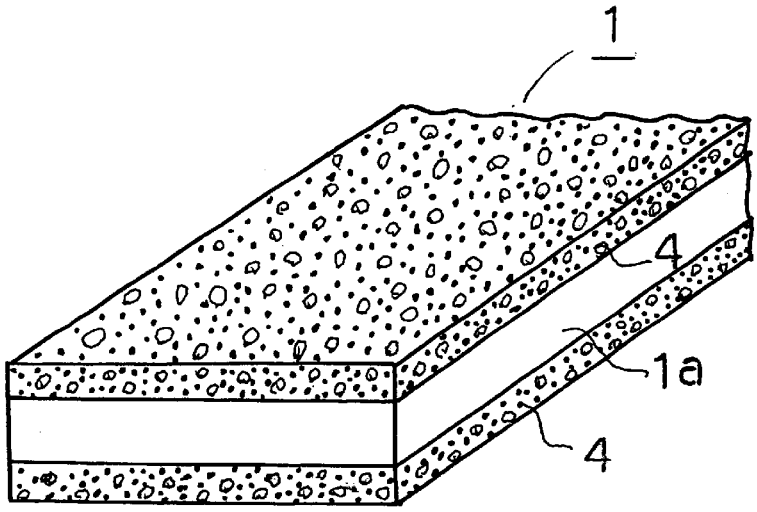
FIG. 4 is a perspective view showing an another embodiment of the polyester tape yarn according to the present invention.

The inorganic filler can be added to the whole of the uniaxial oriented tape 1, but it is also all right to laminate a surface layer 4 made of polyester containing the inorganic filler on one or both sides of the uniaxial oriented tape 1*a* having no inorganic filler added as showing in FIG. 4. Lamination of the polyester having the inorganic filler added on the uniaxial oriented tape 1*a* having no inorganic filler added can maintain the intensity and at the same time improves the feeling.

As for the uniaxial oriented tape 1, it is also possible to laminate different kinds of materials on one or both sides of the polyester resin 1*a* constituting a substratum. Among different kinds of materials usable are olefin series copolymers such as polyesters that are different in melting point, ultimate viscosity, and etc., high density polyethylene, low density polyethylene, linear low density polyethylene, propylene polymer, ethylene-propylene, ethylene-vinyl acetate copolymer and polyamide, and the like.

However, when the both sides are laminated, at least one side should be laminated with the polyester resin. After these thermoplastic resins are laminated to form split yarn, they are heat-treated. This heat treatment crimps the tape yarn to give a mound.

The film-state body thus formed, after or before it is slit into predetermined width, is longitudinally stretched by means of a stretching device, and relaxingly heat-treated. The stretching can be made by means of a hot roll, a heat plate, a heat air circulating oven or the like. The appropriate multiplying factor of stretching is 2.5–12 and, more preferably, around 3–10, and the appropriate stretching temperature is 70–130° C. and, more preferably, around 80–120° C.

The relaxing heat treatment can be made by means of the hot roll, the heat plate, the heat air circulating oven or the like. The appropriate relaxation ratio is 1–15% and, more preferably, around 3–13%, and the appropriate heat treatment temperature is 100–250° C. and, more preferably, around 120–230° C.

The width of the stretched uniaxial oriented tape 1 is made 0.5 mm or more and, more preferably, 0.5–70 mm and, further preferably, around 1.0–50 mm, and its thickness is made 5–200 $\mu$m and, more preferably, around 8–100 $\mu$m, and its fineness is made 30–10000 dt and, more preferably, around 80–8000 dt.

The polyester tape yarn according to the present invention is suitable as the material required for piece dyeing such as fancy work yarn and interior material, since it is excellent in dye affinity, therefore, it can be manufactured, stocked in the form of white or colorless tape yarn, and dyed into any color in response to demand, then shipped.

What is claimed is:

1. Polyester tape yarn that is formed through uniaxial orientation of polyester having the ultimate viscosity of 0.7 or more, and is 1.0 cN/dt or more in tensile strength, 0.8 cN/dt or more in Knot strength represented by the below-mentioned formula (1), 1.8 cN/dt or more in Loop strength represented by the below-mentioned formula (2), and 0.5 mm or more in yarn width.

Knot strength:

$$\text{Knot strength}(cN/dt)=\text{node strength}(N)\times 100/\text{fineness}(dt) \quad \text{Formula (1)}$$

Loop strength:

$$\text{Loop strength}(cN/dt)\text{scratch strength}(N)\times 100/\text{fineness}(dt) \quad \text{Formula (2)}$$

2. Polyester tape yarn according to claim 1 have a lot of slits formed in the longitudinal direction.

3. Polyester tape yarn according to claim 1 made of the polyester containing inorganic filler.

4. Polyester tape yarn according to claim 1 have the face layer made of polyester containing inorganic filler laminated on the one or both sides of the uniaxial oriented tape.

5. Polyester tape yarn according to claim 1 to have a mound through heat treatment of thermoplastic resins different in melting point or ultimate viscosity laminated on polyester.

* * * * *